United States Patent [19]

Link et al.

[11] Patent Number: 4,511,772

[45] Date of Patent: Apr. 16, 1985

[54] ARC EXTINGUISHING STRUCTURE FOR ELECTRICAL SWITCHING DEVICE

[75] Inventors: Donald A. Link, Hubertus; John A. Swessel, Jr., Milwaukee; Peter J. Theisen, West Bend, all of Wis.

[73] Assignee: Eaton Corporation, Cleveland, Ohio

[21] Appl. No.: 493,479

[22] Filed: May 11, 1983

[51] Int. Cl.[3] ..... H01H 33/08

[52] U.S. Cl. ..... 200/144 R; 200/147 R

[58] Field of Search ..... 200/144 R, 147 R

[56] References Cited

U.S. PATENT DOCUMENTS

| | | | |
|---|---|---|---|
| 4,107,497 | 8/1978 | Jencks et al. | 200/144 R |
| 4,255,732 | 3/1981 | Wafer et al. | 200/144 R |
| 4,375,021 | 2/1983 | Pardini et al. | 200/144 R |

FOREIGN PATENT DOCUMENTS

| | | | |
|---|---|---|---|
| 1051935 | 3/1959 | Fed. Rep. of Germany | 200/144 R |

*Primary Examiner*—Robert S. Macon

*Attorney, Agent, or Firm*—C. H. Grace; L. G. Vande Zande

[57] ABSTRACT

An arc extinguishing structure for a circuit breaker (2) wherein an arc chute is provided with a pair of transverse barrier plates (38) spaced apart to provide a centrally located opening (40) and spaced away from an upstanding wall (4*a*) of the breaker housing (4) so as to direct ionized gases associated with an electric arc drawn between separating contacts (8,20) through the arc plates (36) and central opening (40) against the upstanding wall (4*a*) thereby to be redirected along the wall (4*a*) and exhausted to the atmosphere through unrestricted openings (6*a*,4*b*) provided at opposite upper and lower ends of the wall. The barriers (38) project into the areas of the passageways (6*a*,4*b*) to prevent direct access to the switch contacts (8,20) through the passageways and to increase the length of the exhaust path for the arc gases.

16 Claims, 4 Drawing Figures

ARC EXTINGUISHING STRUCTURE FOR ELECTRICAL SWITCHING DEVICE

BACKGROUND OF THE INVENTION

This invention relates to arc extinguishing structures for use in electrical switching devices. More particularly, this invention relates to arc chutes and cooperative venting arrangements in electric circuit breakers.

Arc extinguishing structures employed in molded case circuit breakers or other enclosed electrical switching devices are designed to draw the arc off the switch contacts, rapidly lengthen and fragmentize the arc to dissipate its energy, and to cool the arc associated ionized gases prior to venting the same to the atmosphere. Arc chutes have commonly been employed in devices of the aforementioned type to attract the arc from the contacts and rapidly lengthen and fragmentize it. These arc chutes comprise a plurality of metallic arc plates arranged in a spaced-apart relation along the path of movement of the separating contacts. The arc plates are mounted between a pair of insulating side plates and are assembled to the circuit breaker or switching device housing as a subassembly. The insulating housing of the circuit breaker or switching device is provided with one or more vent openings and passageways leading to the openings for exhausting the arc associated gases. The passageways and vent openings are commonly provided with one or more mesh screens or perforated plates to provide a plurality of surfaces against which the ionized gases may strike and be deflected, thereby cooling and deionizing the gases. Such screens and plates also prevent the direct insertion of a tool or other object into the switching device to interfere with switching operations. However, these additional screens and perforated plates restrict the flow of gas from the housing, thereby creating back pressure at the arc plates which inhibits entry of the arc to the plates, and increased internal pressure which may be harmful to the switch housihg. Moreover, these additional screens and perforated plates increase the manufacturing assembly cost of the switching device.

SUMMARY OF THE INVENTION

This invention provides an electrical switching device which has an arc extinguishing structure comprising a plurality of arc plates spaced along the separation path of the switch contacts, vent openings in an endwall of the switching device housing defining passageways extending interiorly of the housing for venting arc gases exteriorly of the housing, and a barrier spacially interposed between the arc plates and the endwall transverse to the arc plates to project into the path of the arc gases leading to the vent openings for diverting the gases around the barrier, thereby increasing the cooling effect on the arc gases by increasing the length of the venting path. The barrier is arranged to divert the gases at a plurality of locations and in several directions, and to prevent the insertion of tools and other objects into positions of interference with the switching mechanism within the breaker housing through unrestricted vent openings, thereby eliminating the need for restrictive screens, perforated plates or the like in the vent openings and consequently reducing back pressure and pressure within the switching device and reducing the manufacturing cost of the switching device.

The invention and its advantages will become more apparent in the following description of the preferred embodiment when read in conjunction with the accompanying drawings.

DESCRIPTION OF THE PREFERRED EMBODIMENT

Figure 1:
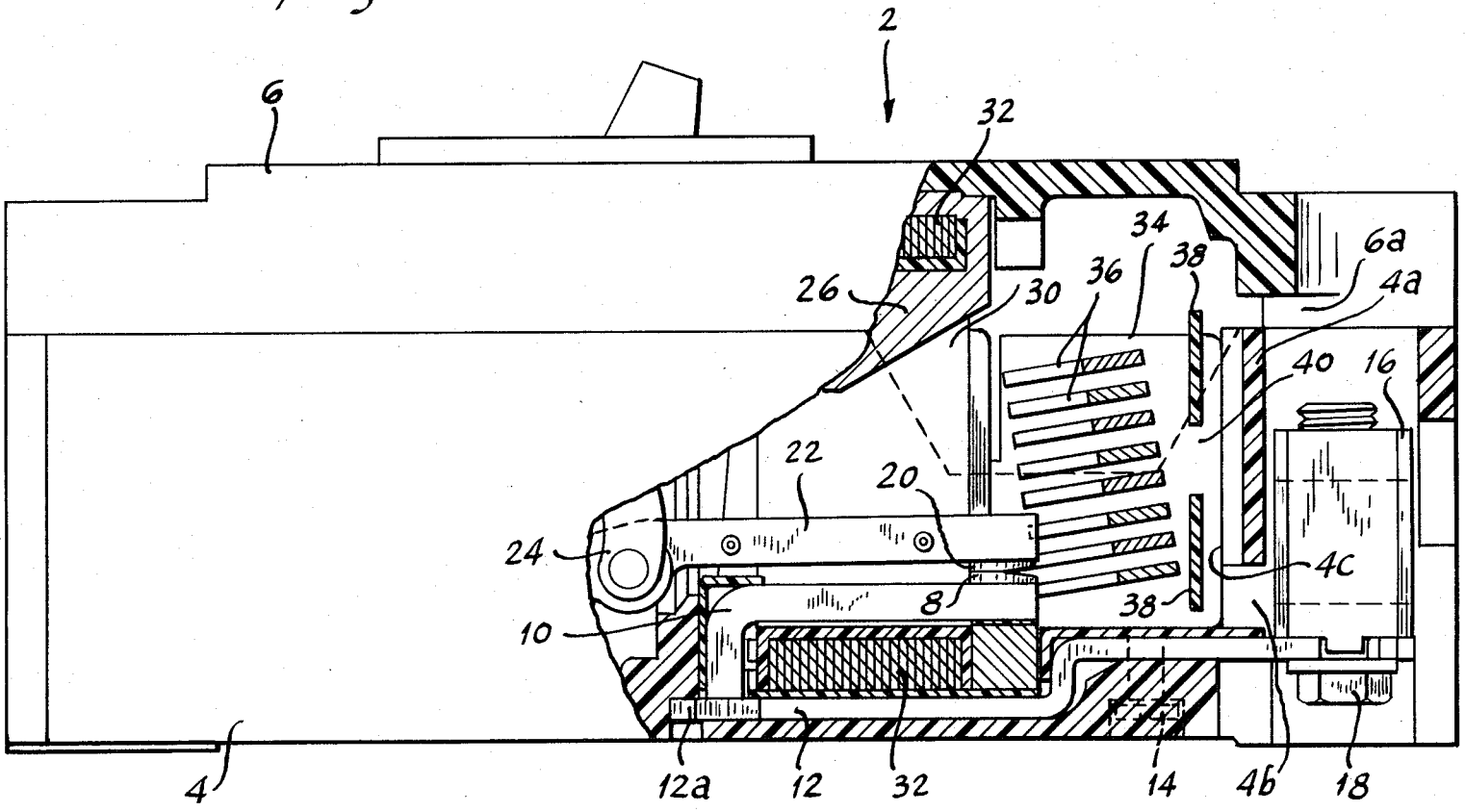
FIG. 1 is a side view partially in section, of an electric circuit breaker embodying the arc estinguishing structure of this invention.
Figure 2:
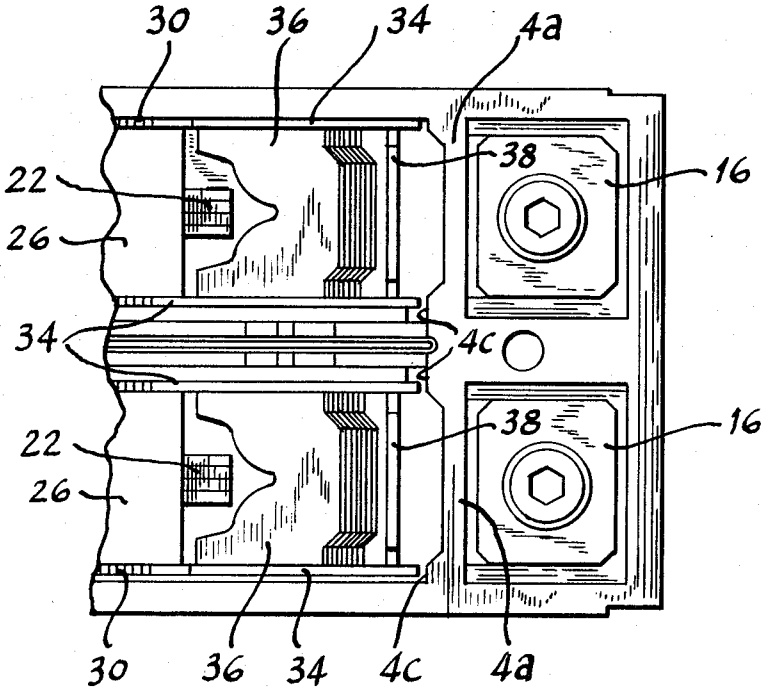
FIG. 2 is a top view of the right-hand end of the circuit breaker of FIG. 1 with a housing cover removed therefrom.

A two-pole molded case circuit breaker 2 is disclosed in the drawings. Circuit breaker 2 comprises a molded insulating base 4 and a molded insulating cover 6 which are secured together by conventional fastening means (not shown). A stationary contact 8 is mounted on the end of a stationary contact support finger 10 which in turn in mounted to a connector plate 12. The connector plate 12 has a tab 12*a* extending from its left-hand end which is received in a cooperating recess in insulating base 4 to position the left-hand end of the connector plate within the base 4. The right-hand end of connector plate 12 is secured to the base by a screw 14 which takes up through an opening in the bottom wall of the base and threadably engages in a hole in the connector plate 12. The right-hand end of the connector plate 12 extends through an opening 4*b* in the right-hand endwall of base 4 and has a wire connecting lug 16 attached thereto by a screw 18.

A movable contact 20 is fixed to the underside of the free end of a movable contact arm 22 which is pivotally mounted within the molded housing of circuit breaker 2. Movable contact arm 22 has connection with a toggle linkage 24 of an operating mechanism for the circuit breaker for moving the movable contact between the closed position as shown in FIG. 1 and an open position wherein the upper surface of contact arm 22 engages a stop member 26. The operating mechanism is substantially identical to that disclosed in U.S. Pat. No. 3,849,751 issued Nov. 19, 1974 to Donald A. Link and Fred H. Williams and assigned to the assignee of this invention. The disclosure of the aforementioned patent is incorporated herein by reference. Also disclosed in the drawings is a magnetic flux amplifier comprising a molded insulating housing 30 having an elongated central aperature in which the stationary contact finger 10 and movable contact arm 22 are disposed. A plurality of ferro-magnetic laminations 32 are disposed over the exterior of the housing 30 to concentrate the magnetic flux generated by current flow in the stationary contact finger 10 and movable contact arm 22 under high short circuit current conditions to cause separation of the contacts independently of the operating mechanism as more fully described in our copending application Ser. No. 399,086, filed July 16, 1982 and assigned to the assignee of this application.

Figure 3:
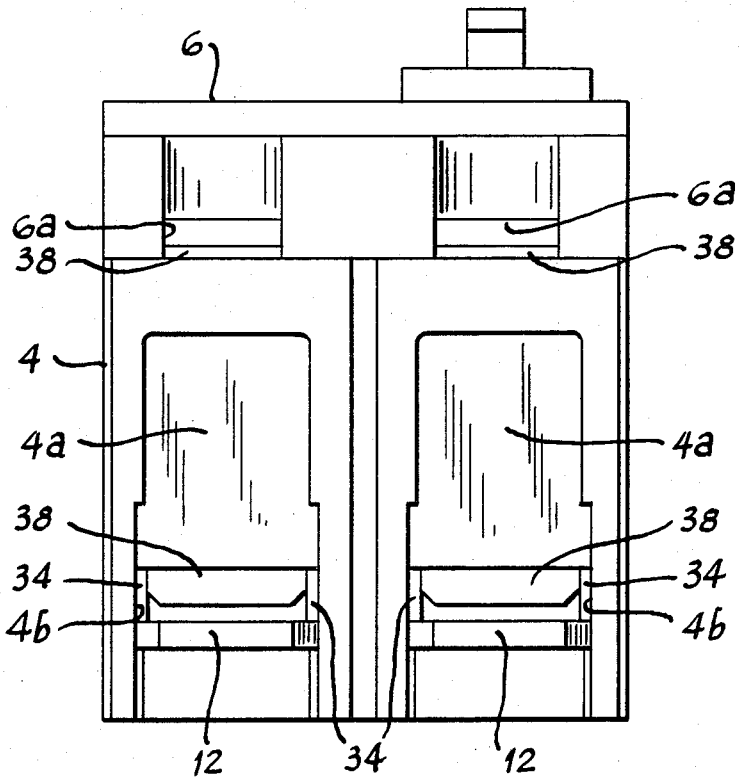
FIG. 3 is an end elevation view of the circuit breaker of FIG. 1 having the wire connecting lugs removed therefrom.

Circuit breaker 2 is a multipole circuit breaker, and is disclosed as a two-pole breaker. Accordingly, each pole of the circuit breaker comprises all of the elements disclosed in FIG. 1 with the exception of the toggle linkage 24 which is present only in one of the two poles in accordance with well known circuit breaker construction. The right-hand endwall 4*a* of molded insulating base 4 in each of the two poles of the breaker has an opening 4*b* adjacent the bottom wall of the base 4. The right-hand end of connector plate 12 is disposed within the bottom portion of the opening 4*b*. The wall 4*a* extends upwardly to the parting plane between base 4 and cover 6. The cover 6 is provided with a pair of openings 6*a* which are disposed immediately above the wall 4*a* in each of the respective poles of the breaker (FIGS. 1 and 3).

Figure 4:
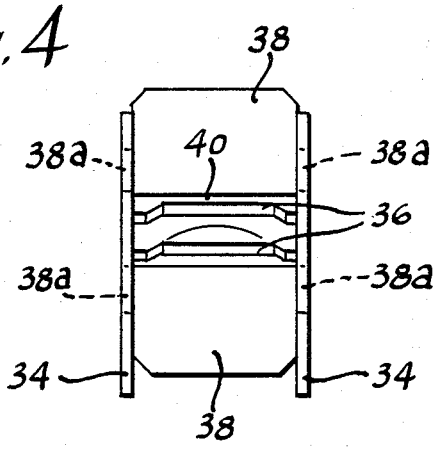
FIG. 4 is an end elevational view of the right-hand end of the arc chute structure of FIG. 1.

Each pole of the circuit breaker receives an identical arc chute structure which comprises a pair of insulating side plates 34 which receive a plurality of spaced metallic arc plates 36 therebetween. While not specifically shown herein, the arc plates 36 may be provided with lateral tabs which are received within corresponding openings in the side plates 34 for positioning the arc plates. The tabs of the upper and lower arc plate may be staked or otherwise deformed to secure the assembly together. A barrier comprising a pair of identical insulating plates 38 is secured transversely across the end of the arc chute structure which is adjacent the endwall 4*a* of base 4. Each of the insulating plates 38 have laterally extending tabs 38*a* (FIG. 4) which are received within corresponding holes in the side plates 34 to entrap the insulators 38 in position as shown in the drawings. As seen in FIGS. 1 and 3 of the drawings, the upper insulating barrier 38 projects into the passageway defined by opening 6*a* and the lower barrier 38 projects downwardly into the passageway defined by openings 4*b*. Accordingly, these insulating barriers prevent direct access through the openings 4*b* or 6*a* to the contacts 8 or 20 by a tool or similar article. Also as seen in FIG. 1, the barriers 38 are spaced from the ends of the arc plates 36 and are spaced from the inner surface of upstanding endwall 4*a* of base 4. The location of barrier plates 38 in the arc chute assembly defines an opening 40 therebetween, which opening is essentially centrally located with respect to the vertical arrangement of the arc plates 36 and also with respect to the location of openings 6*a* and 4*b*. The arc chute assemblies are positioned within the base 4 by engagement of the side plates 34 with ribs 4*c* formed on the interior of base 4 and with housing 30 of the magentic flux amplifier.

In operation, separation of movable contact 20 from stationary contact 8 along a path adjacent the left-hand ends of the respective arc plates 36 causes an arc to be drawn between the contacts 8 and 20. In a well known manner, the arc is drawn to the right into the arc plates 36. The arc creates hot, ionized gases which surround the arc and are vented to the right as viewed in FIG. 1. Some of these gases pass directly through the central opening 40 formed by barriers 38 whereupon they strike the interior surface of upstanding wall 4*a* while others of these gases directly strike the left-hand surfaces of the barrier plates 38 to be diverted through opening 40 or around the respective upper or lower ends of the respective barrier plates. The gases striking wall 4*a* are redirected along that wall toward the passageways formed by openings 6*a* and 4*b*, respectively, or may rebound between the interior surface of wall 4*a* and the right-hand surfaces of barrier plates 38 while generally moving toward the vent openings 6*a* and 4*b*. Thus the arc gases are made to traverse a tortuous path through the opening 40 and in opposite directions along the wall 4*a* and subsequently at right angles through the exhaust passages 6*a*and 4*b* to the exterior of the circuit breaker. This effectively cools the gases by lengthening the path of the gases, providing a plurality of surfaces for the ionized gases to strike against and establishing a turbulence within the breaker. The path for those gases diverted around the upper and lower ends of the respective upper and lower barriers 38 and then through the respective passageways 6*a* and 4*b* is sufficiently long, although not as tortuous, to provide adequate cooling for those gases. The unrestricted exhaust passageways reduce back pressure within the breaker housing which enables the arc to move deeper into the arc chute, thereby to increase the length thereof.

The arc extinguishing structure described herein provides a transverse barrier projecting into the exhaust path of gases created by an electric arc at one or more locations to divert the gases around the barrier projections, thereby to cool the arc gases by increasing the length of the venting path and providing surfaces against which the ionized gases strike, and to omit restrictive screens perforated plates and the like from the exhaust passageways for minimizing back pressure and internal pressure within the housing. Such omissions further tend to reduce the manufacturing cost of the breaker. While a preferred embodiment of the arc extinguishing structure has been described herein, it is to be understood that it is susceptible of various modifications without departing from the scope of the appended claims.

We claim:

1. An electric circuit breaker comprising in combination:

an insulating housing;

separable contacts in said housing;

means for operating said contacts between open and closed positions; and arc extinguishing means comprising:

a plurality of arc plates arranged in spaced-apart relation along a separation route of said contacts for receiving an electric arc and exhausting ionized gases associated with said arc in a path toward an imperforate section of a transverse endwall of said housing;

an unobstructed opening in said endwall adjacent said imperforate section defining a passageway extending interiorly of said hosing for exhausting said gases exteriorly of said housing; and imperforate barrier means spacially interposed between said arc plates and said endwall transversely of said path of said gases and extending into said path for diverting said gases around said barrier toward said passageway, thereby increasing the length of said path for exhausting said gases through said passageway.

2. The invention defined in claim 1 wherein said endwall has a spaced pair of unobstructed openings defining a pair of passageways extending interiorly of said housing, and said barrier means comprises a pair of imperforate sections disposed in spaced relation for defining a window therebetween, said window positioned opposite said endwall imperforate section and between said spaced pair of unobstructed openings for diverting said gases around edges of said barrier sections defining said window toward said passageways.

3. The invention defined in claim 1 wherein said endwall has a spaced pair of unobstructed openings defining a pair of passageways extending interiorly of said housing, and said barrier means has opposite end portions extending into said path at respective ones of said passageways for diverting said gases around respective opposite ends of said barrier means toward said passageways.

4. The invention defined in claim 2 wherein said barrier sections have respective opposite end portions extending into said path at the respective passageways for additionally diverting said gases around said respective opposite ends of said barrier sections toward said passageways.

5. An electric switching device comprising, in combination:

an insulating housing;

separable contacts in said housing;

means for operating said contacts between open and closed positions; and arc extinguishing means comprising:

a plurality of arc plates arranged in spaced-apart relation along the separation path of said contacts for receiving an electric arc drawn between said contacts upon separation;

first barrier means disposed transversely across said arc plates at an end thereof opposite said contacts, said first barrier means being spaced from said arc plates and defining an opening centrally disposed with respect to said arc plate arrangement;

second barrier means disposed transversely across said opening and spaced from said first barrier means, said second barrier means being larger than said opening; and passageways in said housing extending from said second barrier means to the exterior of said housing;

wherein ionized gases associated with an electric arc drawn into said arc plate arrangement are directed through said opening and redirected along said second barrier means to said passageways to increase the path of said gases within said housing.

6. The invention defined in claim 5 wherein said first barrier means extends in opposite directions beyond the extremities of said arc plate arrangement to project into said passageways whereby portions of said gases may be directed around the opposite ends of said first barrier means and into said passageways.

7. The invention defined in claim 5 wherein said second barrier means is substantially coextensive with said arc plate arrangement and said passageways extending from said second barrier means are substantially aligned with the extremities of said arc plate arrangement.

8. The invention defined in claim 7 wherein said first barrier means extends beyond the extremities of said arc plate arrangement to project into said passageways for permitting portions of said gases to be directed around the opposite ends of said first barrier means and into said passageways.

9. The invention defined in claim 5 wherein said arc plates and said first barrier means are mounted between a pair of insulating side plates.

10. The invention defined in claim 9 wherein said first barrier means comprises an insulating member secured at the opposite ends thereof to said side plates.

11. The invention defined in claim 9 wherein said first barrier means comprises a pair of insulating members secured at the opposite ends thereof to said side plates and disposed in spaced-apart relation to define said opening.

12. The invention defined in claim 9 wherein said second barrier means comprises a wall of said insulating housing.

13. Arc extinguishing means for an electric circuit breaker having an insulating housing, separable contacts in said housing, and means for operating said contacts between open and closed positions, said arc extinguishing means comprising, in combination:

an upstanding wall in said housing having upper and lower passageways therein communicating with the exterior of said housing; and an arc chute positioned in said housing between said contacts and said upstanding wall, said arc chute comprising;

a pair of insulating side plates;

a plurality of arc plates mounted between said side plates in spaced-apart relation along the separation path of said contacts; and an insulating barrier mounted between said side plates transversely to said arc plates and spaced from the ends thereof, said barrier further being spaced from said upstanding wall and having a centrally located opening therein having an upright dimension less than the distance between said upper and lower passageways;

wherein ionized gases associated with an electric arc drawn between said contacts upon separation are directed through said arc plates and said central opening in said barrier against said upright wall to be redirected along said wall to said upper and lower passageways, thereby to increase the path of said gases within said housing.

14. The invention defined in claim 13 wherein said insulating barrier extends in opposite directions beyond the upper and lower outermost ones of said arc plates to project into said passageways whereby portions of said gases may be directed around the opposite upper and lower ends of said barrier into said upper and lower passageways, respectively.

15. The invention defined in claim 13 wherein said upper and lower passageways are located respectively above and below the respective outermost upper and lower ones of said arc plates.

16. The invention defined in claim 13 wherein said insulating barrier comprises a pair of insulating plates mounted between said side plates to define a central opening therebetween.

* * * * *